United States Patent [19]

Schroeder

[11] Patent Number: 4,840,407

[45] Date of Patent: Jun. 20, 1989

[54] SHEET MUSIC BINDER

[76] Inventor: Karl S. Schroeder, 6822 Salem Ave., Clayton, Ohio 45315

[21] Appl. No.: 175,930

[22] Filed: Mar. 31, 1988

[51] Int. Cl.[4] ..... B47D 17/00; B42F 1/00; A47B 19/10; A47B 23/06

[52] U.S. Cl. ..... 281/48; 281/47; 248/442.2; 248/445

[58] Field of Search ..... 281/46, 47, 48, 49; 402/6, 7, 8, 9, 10, 19; 40/111; 312/330, 333; 248/309.2, 441.1, 442.2, 444, 445, 446, 447; 414/21; 220/455

[56] References Cited

U.S. PATENT DOCUMENTS

| | | | |
|---|---|---|---|
| 104,122 | 6/1870 | Day . | |
| 936,223 | 10/1909 | Dean | 281/48 |
| 1,452,452 | 4/1923 | West | 281/48 |
| 1,596,741 | 8/1926 | Kranz | 281/47 |
| 1,654,191 | 12/1927 | Redies et al. . | |
| 1,736,908 | 11/1929 | Franey | 281/47 |
| 2,079,388 | 5/1937 | Vetor | 281/47 |
| 3,176,952 | 4/1965 | Gilmore | 281/47 |

*Primary Examiner*—Frank T. Yost
*Assistant Examiner*—Paul M. Heyrana, Sr.
*Attorney, Agent, or Firm*—Roger S. Dybvig

[57] ABSTRACT

A cylindrical array of cables that hold sheets of music in a binder are connected to and stretched along a center post mounted for rotation about an axis parallel to the centerline of the spine of the binder. In use, a first sheet of music is slipped between a cable and the center post and centered behind the cable. A second sheet of music is centered behind the next adjacent cable, and so forth. Successive cables may be exposed by rotating the center post. The cables are preferably formed from elastic bands or loops.

13 Claims, 2 Drawing Sheets

TC
10
12
14
16
18
20
22
24
28
30
32
34
36
38
40
42
44
50
52
54
56
58
60
62
66
68
70
72
74
76

SHEET MUSIC BINDER

SUMMARY OF THE INVENTION

This invention relates to a sheet music binder and is primarily concerned with providing an improved binder for choral sheet music which may also be used for retaining sheets or the like other than choral sheet music.

A common type of sheet music binder comprises a folder having elastic bands stretched over the spine of the folder. Pieces of choral music are inserted under the sides of the elastic bands and thereby removably retained. These are limited to holding a relatively few pieces of music. As pieces are performed they are usually removed from the binder and replaced by other pieces. Such binders are rapidly filled and become awkward to use since the various pieces of music are not inserted in the folder in an orderly fashion. Rather, each new piece is inserted where an empty spot occurs.

An object of this invention is to provide a sheet music binder having improved means for removably retaining the sheets and which is so constructed that more pieces of music can be retained without an increase in the width of the folder than is possible with existing binders.

A further object of this invention is to provide a music binder with which pieces of choral music or the like can be organized easily and conveniently, with pieces of music brought into position for sequential use.

In accordance with this invention, a sheet music binder comprises a folder with hinged front and rear panels and means for removably retaining sheet music or the like in the folder including a rotatable, bracket-mounted, center post assembly centered above the panels. A cylindrical array of circumferentially spaced cables are stretched along the length of the center post for permitting individual pieces of sheet music to be slipped between the cables and the center pot for retaining the sheet music in an organized manner.

The cables are preferably formed from plural, closed-loop elastic bands and the center post assembly preferably has first and second sets of circumferentially spaced pins or tangs at its opposite ends about which the elastic bands are hooked.

In a preferred embodiment, the center post assembly comprises an elongate, preferably hollow, tubular center post and a pair of end caps non-rotatably mounted on each end of the center post. The center post assembly is supported in the folder by a pair of mounting brackets having mutually aligned stub axles for rotatably mounting the end caps. Each of the end caps has an opening rotatably receiving one of the stub axles so that the center post assembly can rotate relative to said mounting brackets. The end caps, which include the tangs for the elastic bands, can be an inexpensive, one-piece molded plastic body, as can each of the mounting brackets. The mounting brackets may be connected to the folder by screws or brads or other suitable fastening means. The presently preferred practice is to mount the brackets by double-sided, pressure-sensitive adhesive tape.

A music binder of this invention is ideally suited for holding a stack of sheet music for use by choir members, such as church choir members, that practice and perform choral numbers in a predetermined order. As each piece is performed, that piece may be removed from the folder so that the uppermost piece will be the next one to be performed. At the same time, the center post assembly may be rotated to permit the introduction of a new piece at the lowest end of the stack.

Other objects and advantages will become apparent from the following description and the drawings.

DETAILED DESCRIPTION

Figures 1, 2, 3:
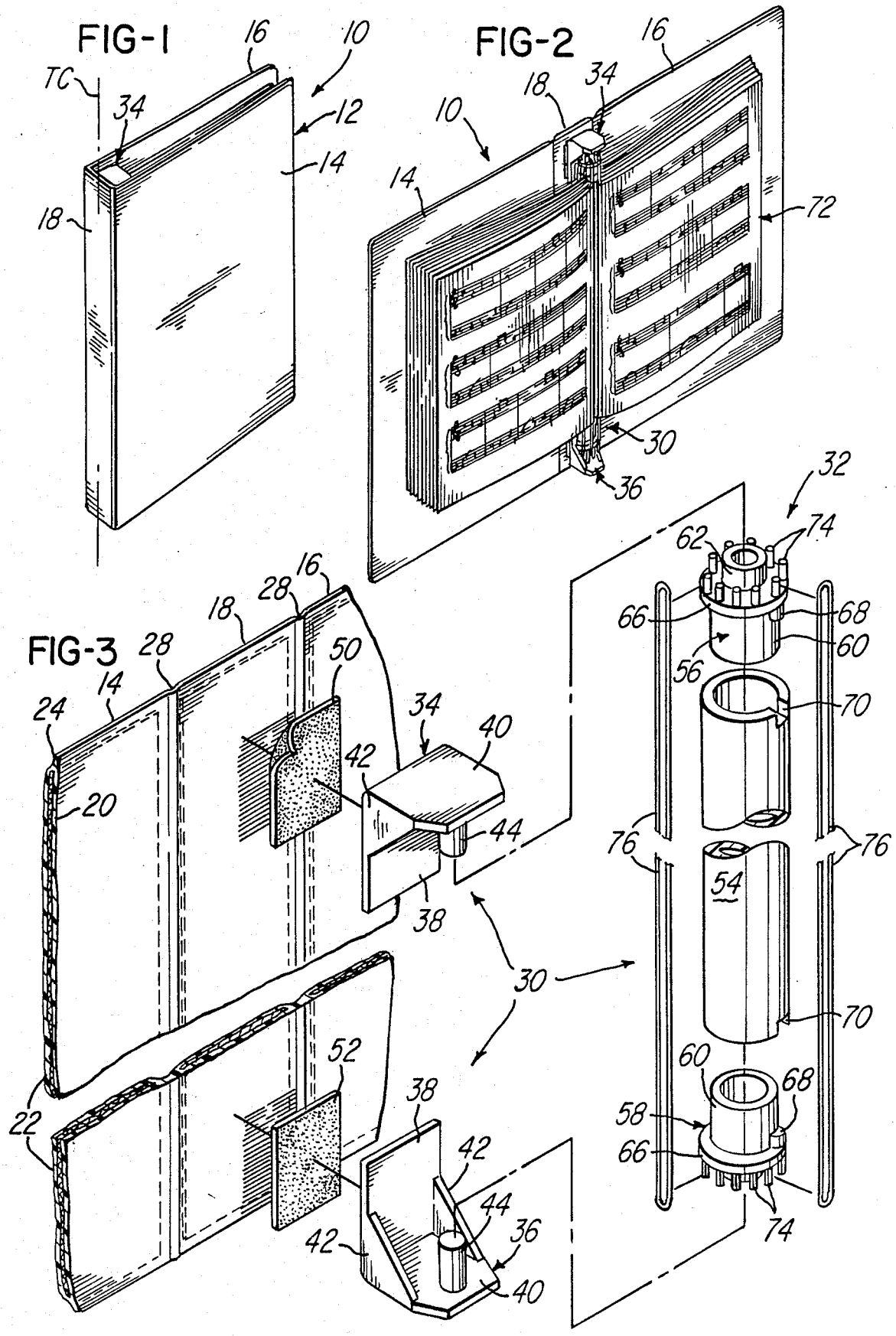
FIG. 1 is a perspective view of a sheet music binder in accordance with this invention, shown closed, with sheet music retained in the binder.
FIG. 2 is a perspective view of the sheet music binder of FIG. 1, shown open, and the retained sheet music.
FIG. 3 is a fragmentary, exploded perspective view of the sheet music binder of FIG. 1.

Referring to the drawings in greater detail, a sheet music binder, generally designated 10, for removably retaining music sheets or the like for sequential use in accordance with this invention is shown closed in FIG. 1 and open in FIG. 2. Binder 10 comprises a folder 12 having a front panel 14 and a rear panel 16 hinged to a center spine 18.

For purposes of the following description and the claims, the terms "inner" and "outer," "front" and "rear," "vertical" and "horizontal," and "upper" and "lower" are used in a relative and not an absolute sense. The binder 10 is deemed to be in an upright or vertical orientation in FIG. 1 and the aforementioned relative terms are used with reference to the positions or locations of parts as shown in FIG. 1. For convenience of description, the vertical centerline TC of the spine 18 is termed the "transverse centerline."

Figure 4:
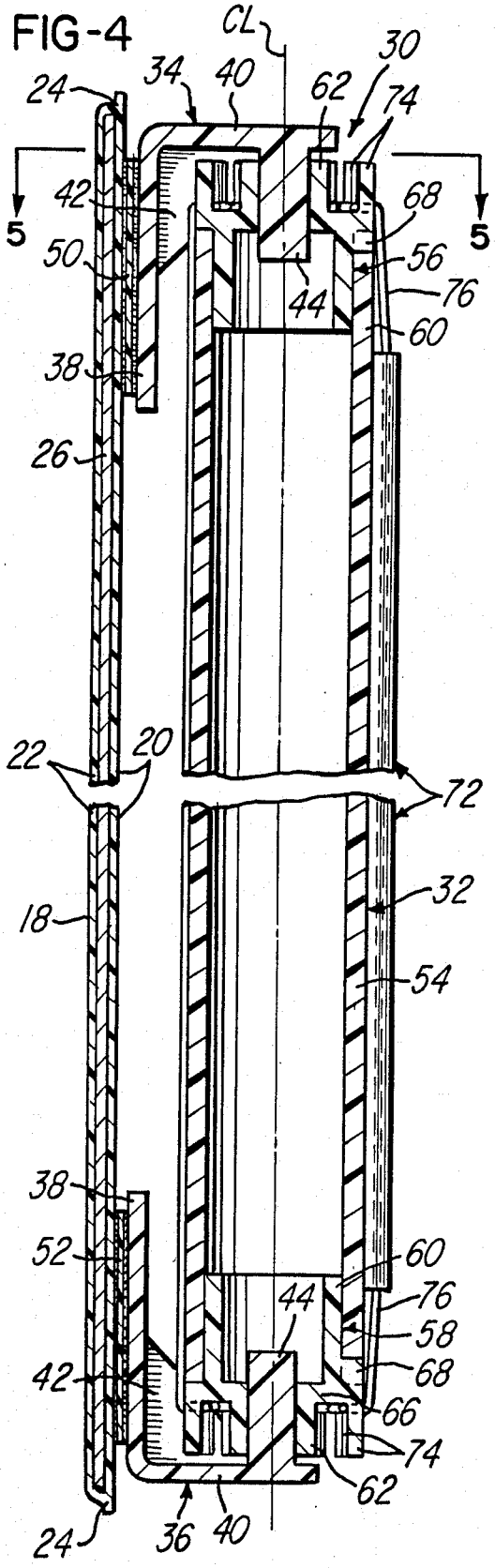
FIG. 4 is a cross-sectional view of the sheet music binder of FIG. 1.
Figure 5:
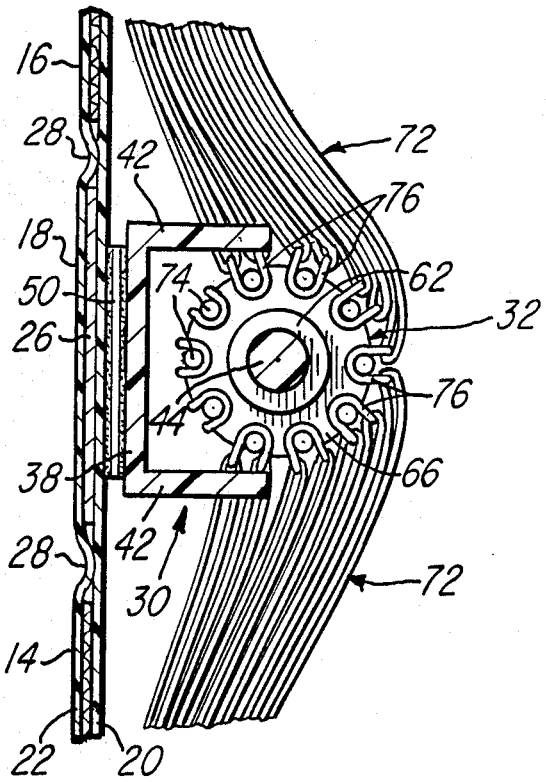
FIG. 5 is a cross-sectional view of the sheet music binder taken along line 5—5 of FIG. 4.

Referring to FIGS. 3, 4 and 5, as common in folders of various kinds, the folder 12 may comprise a jacket made from inner and outer sheets, 20 and 22, respectively, of vinyl or other suitable plastic, joined along their edges as shown at 24 and stiffened by pressboard or other partly rigid plates 26. As shown in FIG. 5, the hinges, designated 28, between the folder panels 14 and 16 and the spine 18 are formed by mutually adhered strips of the inner and outer sheets spanning the spine 18. It is to be understood that this invention is not concerned with the manner in which the folder 12 is made and constructions other than that illustrated and described herein are possible.

In accordance with this invention, a sheet music retaining assembly, generally designated 30, is provided having a center post assembly, generally designated 32, and a pair of mounting brackets, namely an upper mounting bracket 34 and a lower mounting bracket 36. Mounting brackets 34 and 36 are of mutually identical constructions. The upper mounting bracket 34 comprises a generally L-shaped body having a base or vertical leg 38 joining at a right angle to a horizontal leg 40. Gussets 42 may be provided to add strength to the brackets 34 and 36. A stub axle 44 projects from the included or inner face of the horizontal leg 40 along an axis parallel to the base leg 38. Since the lower mounting bracket 36 has the same construction as the upper mounting bracket 34, like reference numbers are applied to like parts.

Double-sided, pressure-sensitive adhesive sheets 50 and 52 are used to attach the mounting brackets 34 and 36 to the inner face of the spine 18 at the upper and lower ends thereof, with their respective stub axles 44 mutually confronting and aligned, to thereby establish a centerline CL about which the center post assembly 32 may rotate. As apparent, the centerline CL is inwardly spaced from and parallel to the transverse centerline TC. Further, the entire retaining assembly 30 is located between the front and rear folder panels 14 and 16 when the binder 10 is closed as shown in FIG. 1, so that the retaining assembly 30 does not interfere with the closing of the binder 10.

With reference to FIGS. 3 and 4, the center post assembly 32 comprises an elongate, hollow, tubular, center post 54 and a pair of end caps 56 and 58. End caps 56 and 58 are of mutually identical construction. Each preferably comprises a single or one-piece molded plastic body formed with an inwardly extending cylindrical hub 60 having an outer diameter of such dimension that it snugly fits within the hollow interior of the center post 54. Each end cap 56 and 58 also has an outwardly extending bearing sleeve 62 that has an internal diameter slightly greater than the external diameter of the stub axles 44 upon which the sleeves 62, and thereby the entire center post assembly 32, are journalled for rotation.

The opposite ends 60 and 62 of each end cap 56 and 58 are separated by a ring-shaped center disk 66 which on its inner face, has a key 68 overlying the hub 60, the key 68 cooperating with a slot 70 in the end of the center post 54 to prevent relative rotation between the end caps 56 and 58 and the center post 54.

In order to removably clamp sheets of music, such as those designated 72 in the drawings, plural pins or tangs 74 project longitudinally of the center post assembly 32 from the outer face of the disk 66 in a cylindrical array surrounding the bearing sleeve 62. Plural, closed-loop elastic bands 76 are stretched along the center post 54 with their ends hooked about the pins or tangs 74. Since the end caps that carry the tangs 74 are keyed to the center post 54, the tangs 74 of the opposite end caps 56 and 58 are maintained in alignment so that the opposite sides of each elastic loop 76 extend in a straight line along the outside of the center post 54.

The materials used to form the retaining assembly 30 are not critical. PVC, ABS, or polypropylene may be used to form the support brackets 34 and 36, the center post 54, and the end caps 56 and 58. ABS is the present material of choice for the molded parts 34, 36, 56, and 58. PVC water pipe, which is both inexpensive and conveniently available, may be used for the center post 54. A conventional and convenient sized binder has front and rear panels which are $11\frac{1}{2}$ inches by $7\frac{1}{2}$ inches with a one inch wide spine. In such cases the center post may have a length of $10\frac{3}{4}$ inches and an outer diameter of $\frac{5}{8}$ inch. The elastic bands 76 may be rubber or other bands, but braided elastic is preferred. Bands made from elastic strip having an unstretched length of $14\frac{1}{2}$ inches have been found satisfactory. As an alternative, the cables could be formed from one or more strands of elastic tied at its ends to one or more tangs 74 and coursed back and forth along the length of the center post 54 and around successsive ones of the tangs 74.

It is believed that the manner of using this invention will be understood from the foregoing description. Briefly, individual pieces of choral music are inserted under a single cable formed by one side of one of the elastic bands 76, by which they are clamped to the outer surface of the center post 54. As each piece is performed, that piece may be removed from the binder 10 so that the uppermost piece will typically be the next one to be performed. At any time, the center post assembly 30 may be rotated to permit the insertion of a new piece at the lowest end of the stack, so that pieces which are to be practiced and then performed at a later date may be inserted in the sequence in which they are to be performed. Another advantage of having a center post is that the cables formed by the elastic bands are in a circular array, as opposed to the more typical planar array, so that more cables are available, without crowding, to hold the pieces of music for a given width of the spine 18.

The pieces of music, which may include one or several sheets 72, do not have to be tightly clamped. Accordingly, the elastic bands 76 do not have to be stretched so tight that they would break easily. While other cable-forming means may be employed, the use of elastic bands is preferred because they are inexpensive and readily replaceable in the event of breakage.

Although the presently preferred embodiment of this invention has been described, various changes may be made within the scope of the appended claims.

I claim:

1. A binder for sheet music comprising:

a folder of the type having hinged front and rear panels and a centerline extending from the top to the bottom thereof;

a center post assembly;

means mounting said center post assembly for rotation relative to said folder about an axis parallel to said centerline and spaced inwardly of said panels; and means for holding sheet music on said center post assembly.

2. A music binder as recited in claim 1 wherein said holding means comprises plural cables extending along said center post assembly whereby individual pieces of sheet music may be slipped between said cables and said center post assembly for retaining said sheets in an organized manner.

3. A music binder as recited in claim 2 wherein said cables comprise plural elastic bands.

4. A music binder as recited in claim 2 wherein said cables are arranged in a cylindrical array.

5. A music binder as recited in claim 2 wherein said center post assembly has a first set of circumferentially spaced tangs at one end thereof and a second set of circumferentially spaced tangs at the other end thereof, and wherein said cables are connected to said tangs.

6. A music binder as recited in claim 1 wherein said means mounting said center post assembly for rotation comprises a pair of mounting brackets each having a mounting surface with means for rotatably supporting the ends of said center post assembly, and means connecting said brackets to said folder with said mounting surfaces facing one another.

7. A music binder as recited in claim 6 wherein said holding means comprises plural cables extending along said center post assembly whereby individual pieces of sheet music may be slipped between said cables and said center post assembly for retaining said sheets in an organized manner.

8. A music binder as recited in claim 7 wherein said cables are arranged in a cylindrical array.

9. A music binder as recited in claim 7 wherein said center post assembly has a first set of circumferentially spaced tangs at one end thereof and a second set of circumferentially spaced tangs at the other end thereof, and wherein said cables are connected to said tangs.

10. A music binder as recited in claim 6 wherein said center post assembly comprises an elongate tubular center post and a pair of end caps non-rotatably mounted on each end of said center post, said means for rotatably supporting the ends of said center post assembly comprising a stub axle and each of said end caps having an opening rotatably receiving one of said stub axles so that said center post assembly can rotate relative to said mounting brackets.

11. A music binder as recited in claim 10 wherein said center post assembly has a first set of circumferentially spaced tangs at one end thereof and a second set of circumferentially spaced tangs at the other end thereof, and wherein said cables are connected to said tangs.

12. A music binder as recited in claim 11 wherein said tangs are on said end caps.

13. A music binder as recited in claim 12 wherein said end caps including said tangs are of a one-piece molded plastic construction.

* * * * *

UNITED STATES PATENT AND TRADEMARK OFFICE

CERTIFICATE OF CORRECTION

PATENT NO. : 4,840,407

DATED : June 20, 1989

INVENTOR(S) : Karl S. Schroeder

It is certified that error appears in the above-identified patent and that said Letters Patent is hereby corrected as shown below:

On the first page, in item [21], "Application No. 175,930" should read --Application No. 175,931--. Column 1, line 39, "pot" should be --post--.

Signed and Sealed this

Second Day of April, 1991

*Attest:*

*Attesting Officer*

HARRY F. MANBECK, JR.

*Commissioner of Patents and Trademarks*